US009074463B2

(12) United States Patent
Coulston et al.

(10) Patent No.: US 9,074,463 B2
(45) Date of Patent: Jul. 7, 2015

(54) METHOD AND DEVICES FOR TERMINATING COMMUNICATION BETWEEN A NODE AND A CARRIER

(75) Inventors: Stephen James Coulston, Houston, TX (US); James Joseph Freeman, Houston, TX (US); Javid A. Majid, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 394 days.

(21) Appl. No.: 12/982,116

(22) Filed: Dec. 30, 2010

(65) Prior Publication Data

US 2012/0169509 A1 Jul. 5, 2012

(51) Int. Cl.
*G01V 3/00* (2006.01)
*E21B 47/12* (2012.01)

(52) U.S. Cl.
CPC ..... *E21B 47/12* (2013.01)

(58) Field of Classification Search
CPC ..... G01V 3/00; E21B 47/12
USPC ..... 340/853.1
See application file for complete search history.

(56) References Cited

U.S. PATENT DOCUMENTS

| | | | | |
|---|---|---|---|---|
| 4,208,593 | A | 6/1980 | Sullivan | |
| 4,329,685 | A | 5/1982 | Mahon et al. | |
| 4,523,194 | A | 6/1985 | Hyde | |
| 4,674,454 | A | 6/1987 | Phairr | |
| 4,825,206 | A * | 4/1989 | Brice et al. | 370/216 |
| 5,188,909 | A | 2/1993 | Pedicini | |
| 5,959,547 | A | 9/1999 | Tubel et al. | |
| 6,269,683 | B1 * | 8/2001 | Jackson | 73/40.5 R |
| 6,414,905 | B1 | 7/2002 | Owens et al. | |
| 6,816,082 | B1 * | 11/2004 | Laborde | 340/853.3 |
| 7,096,961 | B2 * | 8/2006 | Clark et al. | 166/380 |
| 7,248,178 | B2 | 7/2007 | Layton | |
| 7,339,942 | B2 | 3/2008 | Morgan et al. | |
| 8,024,125 | B2 * | 9/2011 | Hsu et al. | 702/11 |
| 8,082,993 | B2 * | 12/2011 | Craig | 166/278 |
| 8,636,062 | B2 * | 1/2014 | Fripp et al. | 166/250.01 |
| 8,637,806 | B2 * | 1/2014 | Kwong et al. | 250/257 |
| 2002/0131362 | A1 * | 9/2002 | Callon | 370/216 |
| 2002/0134552 | A1 * | 9/2002 | Moss | 166/339 |
| 2003/0006906 | A1 * | 1/2003 | Gardner et al. | 340/853.3 |

(Continued)

OTHER PUBLICATIONS

PCT/US2011/058592: International Search Report dated Jun. 22, 2012.

*Primary Examiner* — Amine Benlagsir
(74) *Attorney, Agent, or Firm* — Mossman, Kumar & Tyler PC

(57) ABSTRACT

The present disclosure relates to apparatuses and methods for terminating communication on a communication line between a carrier and at least one node located at a subsurface location. The apparatus may include a control member configured to initiate termination of communication in response to a controlled signal. The apparatus may also include a communication linkage configured to terminate the communication in a manner that cannot be remotely restored in response to the control member. The apparatus may also include a power source to maintain power to the communication linkage termination operation. The apparatus may be configured to use energy from the communication line to cause the communication linkage to terminate communication. The apparatus may be configured to use a communication linkage that is at least partially consumable. The method includes the use of the apparatus.

13 Claims, 4 Drawing Sheets

(56) References Cited

U.S. PATENT DOCUMENTS

| | | | | |
|---|---|---|---|---|
| 2003/0075321 | A1* | 4/2003 | Hall | 166/241.1 |
| 2007/0116257 | A1* | 5/2007 | Duran et al. | 379/413 |
| 2008/0223125 | A1* | 9/2008 | Meister | 73/152.26 |
| 2009/0090513 | A1* | 4/2009 | Bissonnette et al. | 166/380 |
| 2009/0150079 | A1* | 6/2009 | Hsu et al. | 702/11 |
| 2009/0151932 | A1 | 6/2009 | Hall et al. | |
| 2009/0274165 | A1* | 11/2009 | Csaszar et al. | 370/443 |
| 2009/0294123 | A1 | 12/2009 | Mescall et al. | |
| 2010/0016034 | A1* | 1/2010 | Lindqvist et al. | 455/573 |
| 2010/0230098 | A1* | 9/2010 | Craig | 166/278 |
| 2010/0300684 | A1 | 12/2010 | Kotsonis et al. | |
| 2011/0139445 | A1* | 6/2011 | Fripp et al. | 166/250.15 |
| 2012/0091732 | A1* | 4/2012 | Fallet et al. | 290/40 R |
| 2012/0170409 | A1* | 7/2012 | Golla et al. | 367/82 |

* cited by examiner

METHOD AND DEVICES FOR TERMINATING COMMUNICATION BETWEEN A NODE AND A CARRIER

FIELD OF THE DISCLOSURE

This disclosure generally relates to controlling signal communication between a carrier and at least one node positioned at a subsurface location.

BACKGROUND OF THE DISCLOSURE

Often, electronic and hydraulic devices may be situated in inaccessible locations. This inaccessibility may be problematic when it is desirable to isolate one or more of these devices from a larger system. For example, during hydrocarbon exploration and recovery operations, it is common for electronic and hydraulic devices to be operating in a borehole in an earth formation. These devices or nodes may be in communication with other devices and surface operations. Many nodes may be operating in parallel, such that a failure of one device may generate a failure in the whole system. During operations, it may become desirable for communication with one or more devices to be terminated while the device(s) are at their subsurface location. The termination of communication may be used to clear a whole system failure generated by one or more of the nodes. The present disclosure addresses terminating communication with one or more of such nodes.

SUMMARY OF THE DISCLOSURE

In aspects, the present disclosure is related to methods and apparatuses for controlling communication between a carrier and at least one node at a subsurface location.

One embodiment according to the present disclosure may include a method of controlling communication along a carrier, comprising: positioning a communication linkage and at least one node at a subsurface location, the at least one node communicating with the carrier via the communication linkage; and terminating communication between the carrier and the at least one node using a controlled signal, wherein the at least one node destroys at least a part of the communication linkage upon receiving the controlled signal.

Another embodiment according to the present disclosure may includes an apparatus for controlling communication, comprising: a carrier; and at least one node configured to be positioned at a subsurface location, the at least one node including a communication linkage for communicating with the carrier, the at least one node being configured to terminate communication with the carrier by destroying at least a part of the communication linkage upon receiving a controlled signal.

Examples of the more important features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

This disclosure relates to controlling communication between a carrier and at least one node positioned at an inaccessible location, such as a subsurface location. As used herein, the term "subsurface" refers to below the surface of land and/or a body of water, e.g., underwater or subterranean locations. In the discussion below, reference is made to hydrocarbon producing wells. It should be understood that the teachings of the present disclosure may be applied to numerous situations outside of the oil and gas industry. For example, the teachings of the present disclosure may be applied to devices or subsurface structures associated with geothermal wells, water producing wells, pipelines, tunnels, mineral mining bores, etc.

Figure 1:
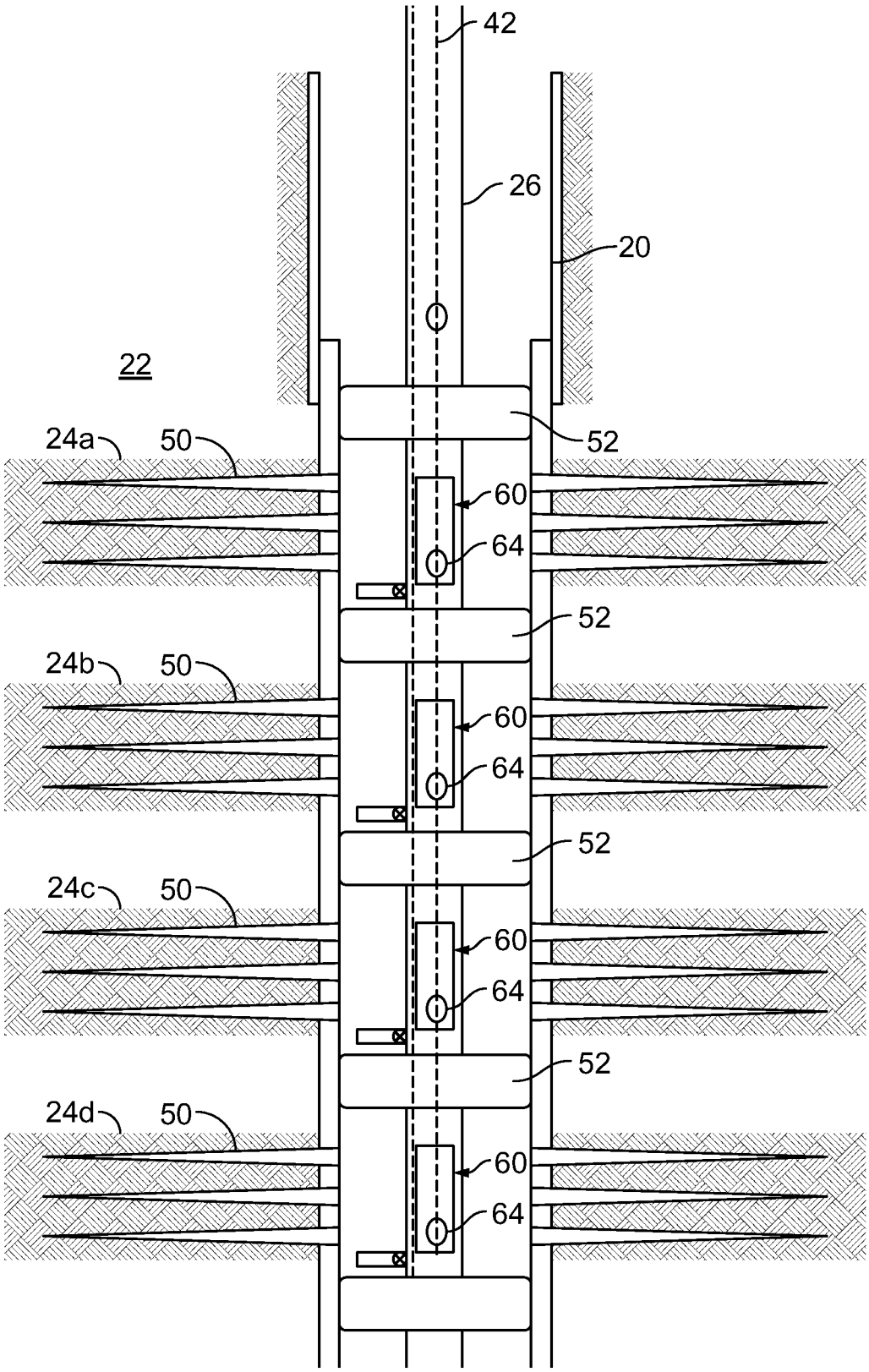
FIG. 1 shows a schematic of a subsurface node deployed in an onshore borehole according to one embodiment of the present disclosure.

Referring initially to FIG. 1, a wellbore or borehole 20 is shown a production well using devices or nodes 60 in communication with a communication line 42 in a carrier 26. The carrier 26 may communicate data and/or power within the borehole 20. The carrier 26 may be rigid or non-rigid. For example, the carrier may be non-rigid carrier such as a tubing encapsulated cable. The carrier may also be a rigid carrier such a "wired" drill pipe. The carrier 26 may be configured to convey signals between the surface and the nodes 60 positioned downhole (e.g. a tubing encapsulated cable). Herein, signals may include, but are not limited, to signals for conveying information and/or energy. Illustrative, but not exhaustive, signals include electromagnetic signals, acoustical signals, pressure pulses, optical signals, etc. Herein, information may include raw data and processed data. The borehole 20 may include multiple production zones 24*a-d*. Packers 52, which may be retrievable packers, may be used to provide zonal isolation for each of the production zones 24*a-d*.

Each zone 24*a-d* may include one or more nodes 60. Herein, a node may be any device that transmits signals to and/or receives signals from the carrier 26. The nodes 60 may include, but are not limited to, one or more of: intelligent well completion equipment, environmental sensors (e.g., pressure, temperature, flow rates, etc.), injectors, flow control devices such as valves, chokes, seals, etc. that are configured to adjust, vary and control flow from the formation into the tubing, electrical/hydraulic actuators, communication devices (e.g., transmitters, receivers, pulsers, etc.), and downhole power generators. Thus, a node may transmit generated information, receive information (e.g., instructions), receive energy, and/or transmit generated energy via the carrier 26. The node 60 may be configured to be positioned at an inaccessible location. An inaccessible location may be a location where intervention to repair or restore communication is not possible or cost prohibitive. A location may be inaccessible due to remoteness, hazardous conditions, dimensional restrictions, etc. Inaccessible locations may include subsurface locations (subsea, subterranean, etc.). While FIG. 1 shows the nodes 60 as well completion equipment, the present disclosure is not limited to equipment used in a completion process.

In some embodiments, one or more of the nodes 60 may include a node terminator 64 configured to terminate at least one aspect of the signal communication between the node 60 and the carrier 26. For example, the uni-directional or bidirectional transmission of signals between a node 60 and the carrier 26 may be terminated by activating a node terminator 64, which may be part of the node 60. Herein, the term "terminate" is used to describe impairing or obstructing the flow of signals to a degree that signals flowing along the carrier 26 do not influence operation of the node 60 and/or the operation or functional status of the node 60 does not influence the flow of signals along the carrier 26. Thus, in embodiments where the carrier 26, the nodes 60, and other devices constitute a system, the activation of node terminator 64 may operationally isolate one or more nodes 60 from the rest of the system. In some embodiments, a node terminator 64 may be configured to terminate or trigger termination of communication for more than one node 60. After the node terminator 64 is activated, the node 60 may be isolated from some or all signals from the carrier 26.

In embodiments, a controlled signal may be used to activate the node terminator 64. Herein, a controlled signal is a signal initiated by surface and/or downhole intelligence (e.g., a suitably programmed microprocessor or human operator). Thus, the controlled signal is a deliberately transmitted signal, as opposed to an errant signal, that is intended to cause a specific response from the node 60. The controlled signal may be generated at the surface, subsurface, in the borehole, or at the node itself. The controlled signal may be produced by a controller (not shown) that may be located at one of: (i) a surface location, (ii) a subsurface location, and (iii) the node 60.

The node terminator 64 may render the node 60 operationally non-responsive to signals conveyed along the carrier 26 after communication has been terminated such that communication may not be restored by sending a second controlled signal. Moreover, the termination may be such that the node 60 may only reacquire signal transmission capability by in situ repair or by retrieval from the inaccessible location for repair.

Figure 2:
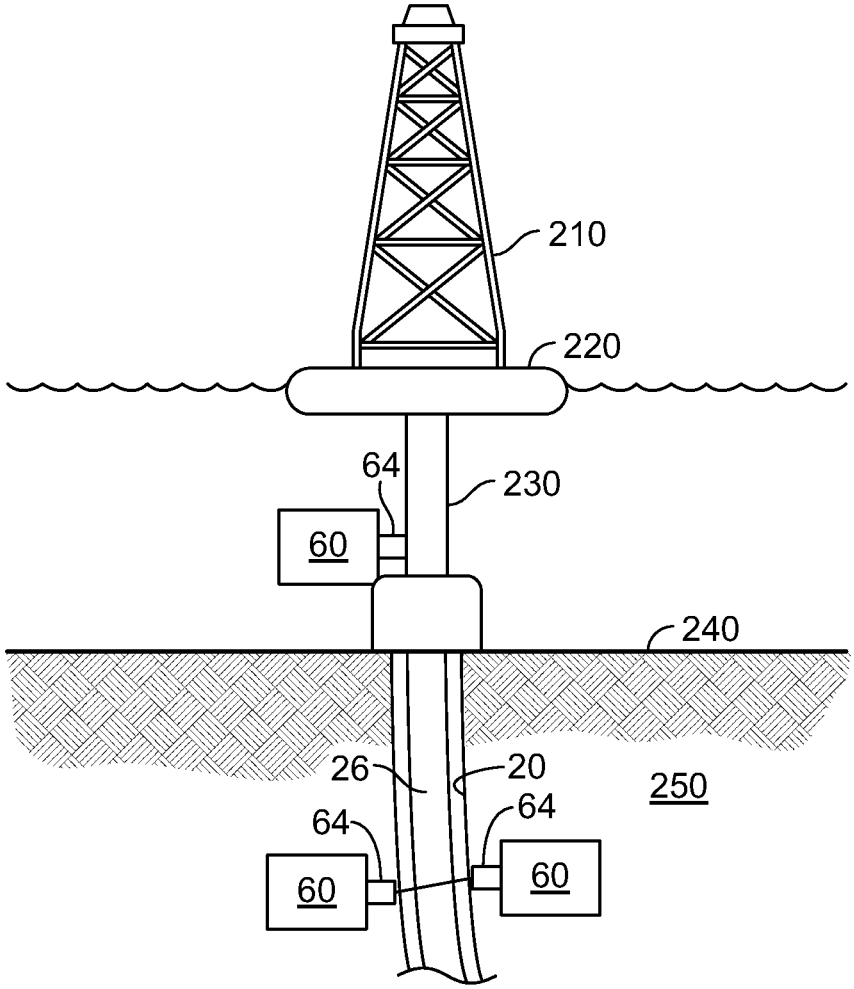
FIG. 2 shows a schematic of another subsurface node deployed in an offshore borehole according to one embodiment of the present disclosure.

FIG. 2 shows an offshore embodiment according to the present disclosure. A drill rig 210 may be supported by a platform 220. A riser 230 may include a carrier 26, which may extend below the sea bed 240 into a borehole 20 in the earth formation 250. Nodes 60 may be positioned along the riser 230 and/or within the borehole 20. As discussed above, the nodes 60 may be in signal communication with the carrier 26, at least in part, through a node terminator 64.

Figure 3:
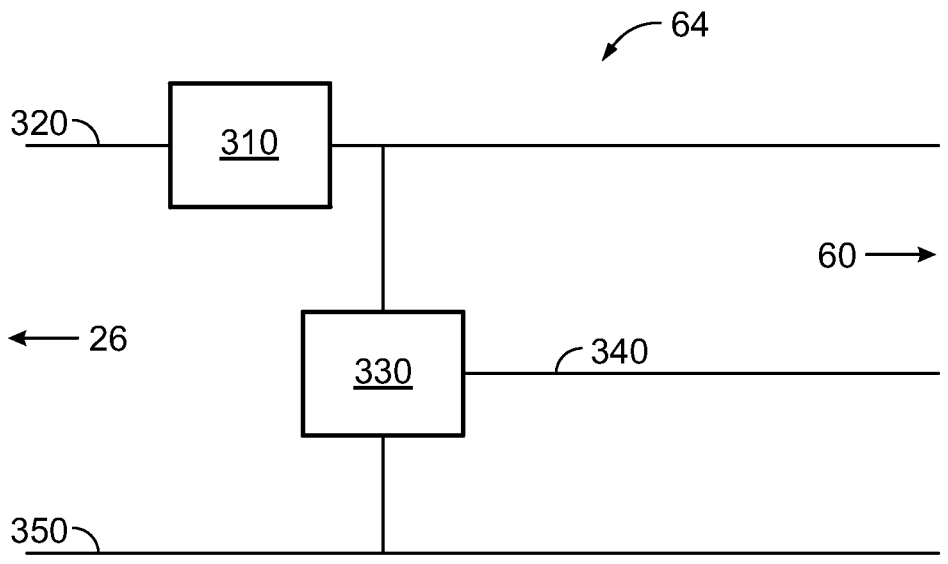
FIG. 3 shows an equivalent circuit diagram of the subsurface node according to one embodiment of the present disclosure.

Aspects of the node terminator 64 are illustrated in FIG. 3, which shows a circuit diagram of one embodiment of a node terminator 64 that terminates signal flow with the carrier 26 upon receiving a controlled signal. The node terminator 64 may include a communication linkage 310 that either directly or indirectly enables signal communication between the node 60 and the carrier 26. The communication linkage 310 may be installed in line with the communication line 320 between the carrier 26 and the node 60. The communication line 320 may be configured to carry signals, e.g., electrical, hydraulic, etc. The node 60 may include a control member 330 configured to initiate an energy flow to the communication linkage 310. The control member 330 may positioned between the communication line 320 and a ground 350, such as cable or carrier armor. Herein, "control member" is used to generically describe a switching device used to control energy from either an energy source or the carrier. The control member 330 may be configured to have at least two states, which may include an open circuit and a closed circuit between the communication line 320 and ground 350. The control member 330 may also be configured to change states in response to a controlled signal on signal line 340. In some embodiments, the control member 330 may be configured to change state permanently (such as a latching relay) regardless of power supplied to the control member in response to the controlled signal. In other embodiments, the control member 330 may require an energy source to maintain its state. Suitable control members may include latching relays, field effect transistors, and other switchable devices known to those of skill in the art with the benefit of this disclosure.

In some embodiments, the node terminator 64 terminates signal communication between the node 60 and the carrier 26 by destroying the communication linkage 310. Herein, "destroyed" means that some aspect of the communication linkage 310, e.g., a conductive material, is converted or transformed into a state that prevents the communication linkage 310 from enabling signal communication, at least to the same effectiveness as prior to being converted/transformed. That is, for example, the communication linkage 310 may be converted/transformed from a signal conveying state to a non-signal conveying state. For example, the material making up a portion of the communication linkage 310 may be disintegrated such that the material no longer conveys electrical signals. One non-limiting suitable element is a "consumable" element. Herein, an element that is "consumed" generally means an element that undergoes a non-reversible, one-time conversion or transformation from one state to another (e.g., substantially conductive to substantially non-conductive). Consumable elements suitable for the communication linkage 310 may include, at least in part, fuses, fusable links, rupture disks, and other elements that are transformed to a desired state by application of mechanical energy (e.g., pressure), electrical energy, thermal energy, etc. Communication linkages that do not have a consumable component include devices that are returned to a functional position (e.g., signal conveying condition) by an external operation (e.g., a latching relay or a latching valve). Illustrative external operations include retrieval from the subsurface location or a well intervention using tools conveyed into the well for in situ operations.

In operation, signals may flow across communication linkage 310 until a controlled signal is received by control member 330 on line 340. Upon receipt of the controlled signal, the control member 330 may close, resulting in a short circuit between the communication line 320 and ground 350. In some embodiments, the control member 330 may be supplied with energy through part or all of the disconnection operation. When the short circuit is formed, sufficient energy from the communication line 320 will flow to communication linkage 310 resulting in the consumption of at least part of communication linkage 310 and terminating communication. The consumption of at least part of communication linkage 310 may directly or indirectly terminate the flow of signals between the node 64 and the carrier 26.

It should be appreciated that the power parameters (e.g., voltage or pressure) associated with the communication line 320 did not have to be adjusted or set in order to isolate the node 60 from the carrier 26. That is, the termination of communication does not necessarily depend on a voltage or pressure change or value of communication line 320. Thus, the node 60 may be isolated in an operation that is independent of the operation of the carrier 26.

Figure 4:
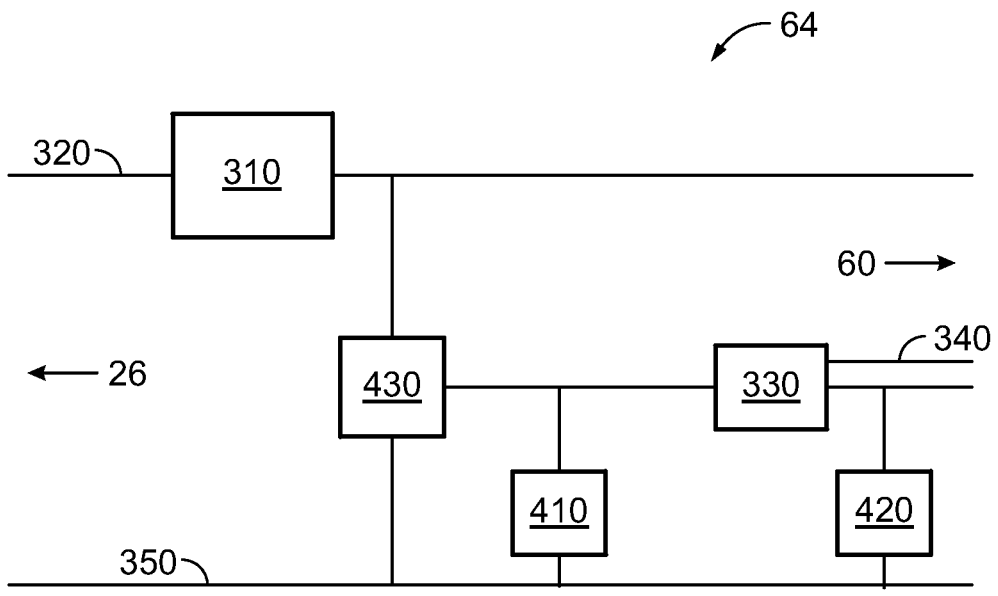
FIG. 4 shows an equivalent circuit diagram of the subsurface node according to another embodiment of the present disclosure.

FIG. 4 shows a circuit diagram of another embodiment of node terminator 64 that uses an energy source 420 and dual control members 330, 430. In this embodiment, the control member 330 indirectly initiates an energy flow to destroy at least part of the communication linkage 310 by using the control member 430. Here, control member 330 receives a controlled signal on signal line 340 and is in electrical communication with the second control member 430 and an energy source 420. Second control member 430 may be positioned between communication line 320 and ground 350. The second control member 430 may be configured to have at least two states, which may include an open circuit and a closed circuit between the communication line 320 and ground 350. In some embodiments, a resistor 410 may be coupled between control member 330 and second control member 430 to dissipate energy from energy source 420 to ground 350. Energy source 420 may be a stored energy source that does not receive energy from communication line 320. Energy source 420 may be any energy storage device, including, but not limited to, one of: (i) a battery, (ii) a reservoir, (iii) a capacitor, and (iv) an inductor.

In operation, signals may flow across communication linkage 310 until the node 60 receives a controlled signal. The controlled signal may be received by control member 330 on signal line 340. Upon receipt of the controlled signal, the control member 330 may close, resulting in a short circuit between the energy source 420 and the second control member 430. The energy from energy source 420 may then activate second control member 430 causing a short circuit between communication line 320 and ground 350. In some embodiments, the control members 330, 430 may be supplied with energy through part or all of the disconnection operation. When the short circuit is formed, sufficient energy from the communication line 320 will flow to communication linkage 310 resulting in the consumption of at least part of communication linkage 310 and terminating communication. The consumption of at least part of communication linkage 310 may be a direct or an indirect cause of the termination of communication.

Figure 5:
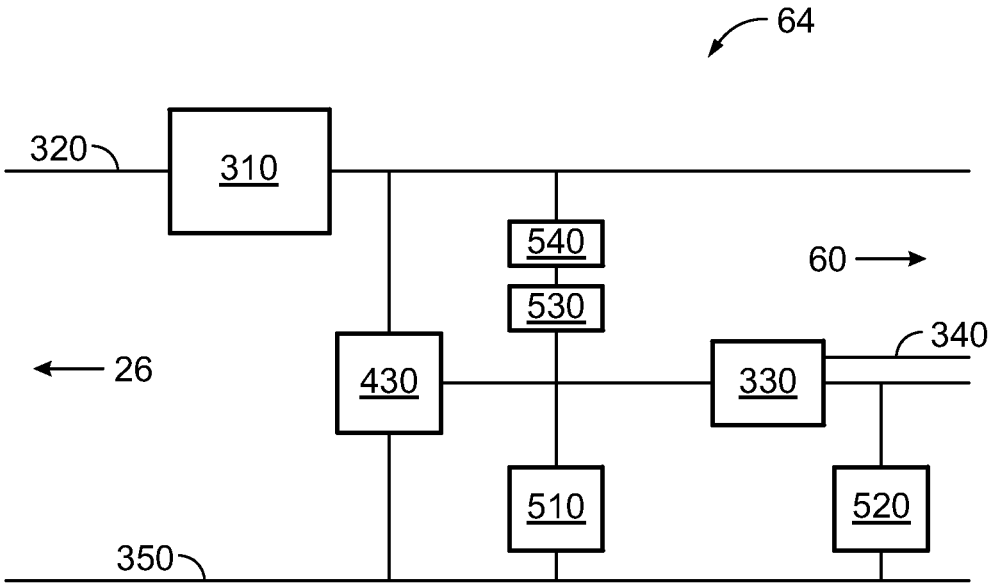
FIG. 5 shows an equivalent circuit diagram of the subsurface node according to another embodiment of the present disclosure.

FIG. 5 shows a circuit diagram of another embodiment of node terminator 64 according to the present disclosure using a second consumable element. The control member 330 may be in electrical communication with an element 510 and an energy source 520. Element 510 may include, at least in part, a consumable element in element 510 of the same type or different from the consumable element in communication linkage 310. Energy source 520 may be configured to store and release sufficient energy to consume at least part of element 510. The element 510 may be in electrical communication with control member 330 and ground 350. Second control member 430 in electrical communication with communication line 320 and ground 350. The second control member 430 may be configured to have at least two states, which may include an open circuit and a closed circuit between the communication line 320 and ground 350. In some embodiments, second control member 430 may be powered by energy source 520. In some embodiments, a one way flow element 530 (e.g. diode, check valve) and a resistive element 540 may be coupled and positioned between the communication line 320 and element 510.

In operation, signals may flow across communication linkage 310 until a controlled signal is received by control member 330 on signal line 340. Upon receipt of the controlled signal, the control member 330 may close, resulting in a short circuit between the energy source 520 and the second control member 430 and between the energy source 520 and the element 510. Sufficient energy from energy source 520 may then flow to the element 510 resulting in the consumption of at least part of element 510 and forming an open circuit. With an open circuit formed, second control member 430 may no longer be held to ground 350 through element 510 and may be energized by energy source 520 and/or by the communication line 320. Second control element 430 may activate and cause a short circuit between communication line 320 and ground 350. The short circuit may result in sufficient energy to flow from communication line 320 to communication linkage 310 to consume at least part of communication linkage 310. The consumption of at least part of communication linkage 310 may be a direct or an indirect cause of the termination of communication. In some embodiments, the control members 330, 430 may be supplied with energy through part or all of the disconnection operation.

While the foregoing disclosure is directed to the one mode embodiments of the disclosure, various modifications will be apparent to those skilled in the art. It is intended that all variations be embraced by the foregoing disclosure.

We claim:

1. A method of controlling a communication along a carrier, comprising:

using the carrier to communicate electrical energy;

positioning a communication linkage and at least one node at a subsurface location, the at least one node in the communication with the carrier via the communication linkage, the at least one node comprising:

a control member to initiate an energy flow to the communication linkage, and a second control member to form a circuit that allows the energy flow to have a sufficient electrical energy flow to destroy at least a part of the communication linkage, wherein the at least the part of the communication linkage includes a consumable element, and wherein applying the sufficient electrical energy flow from the carrier transforms the consumable element into a disintegrated state to cause to non-reversibly terminating the communication between the carrier and the at least one node;

activating the control member and the second control member using a controlled signal:

destroying the at least the part of the communication linkage upon receiving the controlled signal; and using the controlled signal to said non-reversibly terminating the communication between the carrier and the at least one node.

2. The method of claim 1, wherein the communication with the at least one node cannot be restored by transmitting a second controlled signal to the at least one node.

3. The method of claim 1, further comprising maintaining the at least one node in substantial signal isolation from the carrier after termination and while the at least one node is at the subsurface location.

4. The method of claim 1, wherein the at least one node is operationally non-responsive to signals conveyed along the carrier after the communication between the carrier and the at least one node is terminated.

5. The method of claim 1, wherein said non-reversibly terminating the communication between the carrier and the at least one node causes a reduction in flow, between the carrier and the at least one node, of at least one of: information and radiation.

6. The method of claim 1, wherein the carrier is coupled to a system and wherein said non-reversibly terminating the communication between the carrier and the at least one node operationally isolates the at least one node from the system.

7. An apparatus for controlling communication, comprising:

a carrier; and at least one node to be positioned at a subsurface location, the at least one node including:

a communication linkage for communicating with the carrier using electrical energy, wherein at least a part of the communication linkage includes a consumable element;

a control member to initiate an energy flow to the communication linkage, and a second control member to form a circuit that allows the energy flow to have a sufficient electrical energy flow to destroy the at least the part of the communication linkage, wherein the control member activates the second control member upon receiving a controlled signal, and wherein applying the sufficient electrical energy flow from the carrier transforms the consumable element into a disintegrated state to cause to non-reversibly terminating the communication between the carrier and the at least one node;

wherein said non-reversibly terminating the communication between the carrier and the at least one node, by destroying the at least the part of the communication linkage upon receiving the controlled signal.

8. The apparatus of claim 7, wherein the consumable element is selected from at least one of: (i) a fuse, (ii) a fusable linkage, and (iii) a rupture disk.

9. The apparatus of claim 7, wherein the control member comprises at least one of: (i) a relay, (ii) a double pole latching relay, (iii) a single pole latching relay, (iv) a transistor, and (v) a field effect transistor, and (vi) a valve.

10. The apparatus of claim 7, wherein the at least one node includes a power source, and wherein the control member activates the second control member using the power source.

11. The apparatus of claim 7, wherein the energy flow includes at least one of: (i) electrical energy and (ii) hydraulic energy.

12. The apparatus of claim 7, wherein the energy flow is from the carrier.

13. The apparatus of claim 7, further comprising a controller for transmitting the controlled signal, the controller being positioned at one of: (i) a surface location, (ii) the subsurface location, (iii) a subsea location, and (iv) the at least one node.

* * * * *